US012000031B2

(12) United States Patent
Barker et al.

(10) Patent No.: US 12,000,031 B2
(45) Date of Patent: Jun. 4, 2024

(54) METAL PRODUCTS HAVING IMPROVED SURFACE PROPERTIES AND METHODS OF MAKING THE SAME

(71) Applicant: Novelis Inc., Atlanta, GA (US)

(72) Inventors: Simon William Barker, Woodstock, GA (US); Rajasekhar Talla, Woodstock, GA (US); Sazol Kumar Das, Acworth, GA (US); Tudor Piroteala, Acworth, GA (US); Milan Felberbaum, Lausanne (CH); Samuel Robert Wagstaff, Marietta, GA (US)

(73) Assignee: NOVELIS INC., Atlanta, GA (US)

( * ) Notice: Subject to any disclaimer, the term of this patent is extended or adjusted under 35 U.S.C. 154(b) by 11 days.

(21) Appl. No.: 16/352,276

(22) Filed: Mar. 13, 2019

(65) Prior Publication Data

US 2019/0284667 A1 Sep. 19, 2019

Related U.S. Application Data

(60) Provisional application No. 62/642,636, filed on Mar. 14, 2018.

(51) Int. Cl.
*C22F 1/04* (2006.01)
*B22D 11/00* (2006.01)
(Continued)

(52) U.S. Cl.
CPC ..... *C22F 1/04* (2013.01); *B22D 11/003* (2013.01); *B22D 11/0605* (2013.01);
(Continued)

(58) Field of Classification Search
CPC .. C22F 1/053; C22F 1/047; C22F 1/05; C22F 1/002; C22F 1/04–057; C22C 21/10;
(Continued)

(56) References Cited

U.S. PATENT DOCUMENTS 3,612,151 A 10/1971 Harrington et al.
3,933,193 A 1/1976 Baker et al.
(Continued)

FOREIGN PATENT DOCUMENTS

CN 1942595 4/2007
CN 106164308 11/2016
(Continued)

OTHER PUBLICATIONS

PCT Application No. PCT/US2019/022011 , International Search Report and Written Opinion issued in dated May 13, 2019, 14 pages.
(Continued)

*Primary Examiner* — Adil A. Siddiqui
(74) *Attorney, Agent, or Firm* — Kilpatrick Townsend & Stockton LLP

(57) ABSTRACT

Provided herein are continuously cast aluminum alloy products exhibiting uniform surface characteristics. The aluminum alloy products have a first surface comprising a width, wherein the first surface comprises an average of 50 exudates or less per square centimeter across the width of the first surface. Also provided herein are methods of making aluminum alloy products having improved surface characteristics. Further provided are methods and systems for manufacturing aluminum alloy products, such as sheets, having reduced surface defects.

10 Claims, 9 Drawing Sheets

(51) Int. Cl.

| | |
|---|---|
| ***B22D 11/06*** | (2006.01) |
| ***C22C 21/06*** | (2006.01) |
| ***C22C 21/08*** | (2006.01) |
| ***C22C 21/10*** | (2006.01) |
| ***C22F 1/00*** | (2006.01) |
| ***C22F 1/047*** | (2006.01) |
| ***C22F 1/05*** | (2006.01) |
| ***C22F 1/053*** | (2006.01) |

(52) U.S. Cl.
CPC ..... *C22C 21/06* (2013.01); *C22C 21/08* (2013.01); *C22C 21/10* (2013.01); *C22F 1/002* (2013.01); *C22F 1/047* (2013.01); *C22F 1/05* (2013.01); *C22F 1/053* (2013.01)

(58) Field of Classification Search
CPC ... C22C 21/06; C22C 21/08; C22C 21/00–18; B22D 11/0605; B22D 11/003; B22D 11/00; B22D 11/06–0608; B22D 11/0622–0634; B22D 11/0637–0677; B22D 21/007
See application file for complete search history.

(56) References Cited

U.S. PATENT DOCUMENTS

| | | | | |
|---|---|---|---|---|
| 4,028,141 | A | 6/1977 | Chia et al. | |
| 4,409,296 | A | 10/1983 | Ward | |
| 4,485,839 | A * | 12/1984 | Ward | B22D 19/14 164/423 |
| 4,602,668 | A * | 7/1986 | Bolliger | B22D 41/60 164/452 |
| 4,753,685 | A | 6/1988 | Usui et al. | |
| 5,244,516 | A * | 9/1993 | Kawaguchi | C22F 1/047 148/439 |
| 5,515,908 | A | 5/1996 | Harrington | |
| 6,044,896 | A * | 4/2000 | Harrington | B22D 11/0605 164/428 |
| 6,579,387 | B1 | 6/2003 | Selepack et al. | |
| 2003/0150587 | A1* | 8/2003 | Li | C22F 1/04 164/452 |
| 2004/0094245 | A1 | 5/2004 | Li et al. | |
| 2004/0129353 | A1 | 7/2004 | Verma et al. | |
| 2005/0086784 | A1 | 4/2005 | Li et al. | |
| 2005/0211350 | A1* | 9/2005 | Unal | C22F 1/05 148/694 |
| 2006/0191664 | A1* | 8/2006 | Sulzer | B22D 11/0605 164/481 |
| 2013/0089457 | A1* | 4/2013 | Miyanaga | C04B 41/5064 420/407 |
| 2015/0071816 | A1* | 3/2015 | Unal | C22C 21/08 420/534 |

FOREIGN PATENT DOCUMENTS

| | | |
|---|---|---|
| CN | 107002177 | 8/2017 |
| GB | 1387992 A | 3/1975 |
| JP | 59157249 | 9/1984 |
| JP | H06297113 | 10/1994 |
| JP | 2004137601 | 5/2004 |
| JP | 2008531285 | 8/2008 |
| JP | 2016102260 | 6/2016 |
| JP | 2016536465 | 11/2016 |
| WO | 2013111884 | 8/2013 |

OTHER PUBLICATIONS

Chinese Application No. 201980026094.0, Office Action, dated Jun. 8, 2021, 22 pages.
European Application No. 19713651.8, Office Action, dated Jun. 24, 2021, 8 pages.
Indian Application No. 202017039299, First Examination Report, dated Jul. 16, 2021, 7 pages.
Canadian Application No. 3,093,085 , Office Action, dated Sep. 13, 2021, 3 pages.
Japanese Application No. 2020-548631 , Office Action, dated Oct. 26, 2021, 11 pages.
Korean Application No. 10-2020-7028746 , Office Action, dated Sep. 24, 2021, 14 pages.
Canadian Application No. 3,093,085 , Office Action, dated Mar. 23, 2022, 4 pages.
Chinese Application No. 201980026094.0 , Office Action, dated Feb. 17, 2022, 22 pages.
European Application No. 19713651.8 , Office Action, dated Mar. 4, 2022, 7 pages.
Japanese Application No. 2020-548631 , Notice of Decision to Grant, dated Mar. 15, 2022, 3 pages.
Korean Application No. 10-2020-7028746 , Office Action, dated Jan. 11, 2022, 15 pages.
Korean Application No. 10-2022-7004532 , Office Action, dated Apr. 5, 2022, 4 pages.
"500 Questions on Continuous Casting", Metallurgical Industry Press, Jul. 31, 1999, p. 40.
CN201980026094.0 , "Office Action", dated Jun. 14, 2022, 20 pages.
Yong et al., "Practical Manual of Modern Continuous Casting", Metallurgical Industry Press, Mar. 31, 2010, pp. 318-319.
CN201980026094.0 , "Office Action", dated Sep. 28, 2022, 15 pages.
EP19713651.8 , "Notice of Decision to Grant", dated Nov. 4, 2022, 2 pages.
BR112020018546-9 , "Office Action", dated Jan. 10, 2023, 4 pages.
CA3093085 , "Notice of Allowance", dated May 2, 2023, 1 page.
Jingan et al., "Key Techniques of Aluminum Strip Production", Chongqing University Press, May 1995, 1 page, no English translation available.
KR10-2022-7004532 , "Notice of Decision to Grant", dated May 1, 2023, 5 pages.
BR112020018546-9 , "Office Action", dated Oct. 1, 2023.

* cited by examiner

METAL PRODUCTS HAVING IMPROVED SURFACE PROPERTIES AND METHODS OF MAKING THE SAME

CROSS-REFERENCE TO RELATED APPLICATION

This application claims the benefit of U.S. Provisional Patent Application No. 62/642,636, filed Mar. 14, 2018, which is incorporated by reference herein in its entirety.

FIELD

The present disclosure relates to metallurgy generally and more specifically to metal surface science.

BACKGROUND

Continuously cast metals can suffer from surface defects resulting from the casting method and also from thermal processes during forming. It can be desirable to produce a continuously cast metal product free of surface defects.

SUMMARY

Covered embodiments of the invention are defined by the claims, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings and each claim.

Described herein are aluminum alloy products. In some cases, the aluminum alloy products comprise a first surface having a width, wherein the first surface includes, on average, 50 exudates or less per square centimeter ($cm^2$) across the width of the first surface. The exudates can be a plurality of intermetallic particles (e.g., a plurality of iron-containing intermetallic particles). Optionally, on average, each of the exudates has a diameter of from about 50 μm to about 300 μm. The exudates can extend from the first surface into an interior of the aluminum alloy product to a depth of about 10 μm to about 100 μm (e.g., from about 10 μm to about 30 μm). The aluminum alloy product can be a 1xxx series aluminum alloy, a 2xxx series aluminum alloy, a 3xxx series aluminum alloy, a 4xxx series aluminum alloy, a 5xxx series aluminum alloy, a 6xxx series aluminum alloy, a 7xxx series aluminum alloy, or an 8xxx series aluminum alloy.

Also described herein are methods of producing a metal strip. The methods comprise providing a molten metal, continuously casting to form a cast metal article from the molten metal, and hot rolling the cast metal article after casting at a hot rolling temperature of at least about 350° C. to a gauge of about 10 mm or less to produce a metal strip, wherein the hot rolling step results in a thickness reduction of the cast metal article by at least about 50%. Optionally, the hot rolling temperature is from about 450° C. to about 600° C. The cast metal article can be a cast metal sheet. In some cases, the cast metal sheet comprises an aluminum alloy sheet (e.g., a 6xxx series aluminum alloy sheet, a 5xxx series aluminum alloy sheet, or a 7xxx series aluminum alloy sheet). As described above, the first surface of the aluminum alloy sheet has a width, and the first surface can include, on average, 50 exudates or less per $cm^2$ across the width of the first surface. Optionally, on average, each of the exudates has a diameter of from about 50 μm to about 300 μm and, in some cases, the exudates include iron-containing intermetallic particles.

Further described herein are metal products prepared according to the methods for producing metal strips as described herein. The metal product can include an aluminum alloy substrate having a first surface with a width, wherein the first surface has, on average, 50 exudates or less per $cm^2$ across the width of the first surface. Optionally, on average, each of the exudates has a diameter of from about 50 μm to about 300 μm and, in some cases, the exudates include iron-containing intermetallic particles.

Also described herein is a continuous casting system having a pair of moving opposed casting surfaces, a casting cavity between the pair of moving opposed casting surfaces, and a molten metal injector having a molten metal injector nozzle. In some cases, a top or bottom surface of the molten metal injector nozzle has a distal most end that is positioned at a vertical distance of about 1.4 mm or less from at least one moving casting surface in the pair of moving opposed casting surfaces. For example, the vertical distance between the distal most end of the molten metal injector nozzle and the at least one moving casting surface in the pair of moving opposed casting surfaces is about 1.0 mm or less. The pair of moving opposed casting surfaces can be a pair of moving opposed belts, opposed blocks, or opposed rolls. Positioning the molten metal injector nozzle at a distance of 1.4 mm or less from the pair of moving opposed casting surfaces can help reduce the number of exudates present in the surface of the cast molten metal sheet.

A method of continuously casting a metal article is also described herein. The method includes providing a molten metal and continuously injecting the molten metal from a molten metal injector nozzle into a casting cavity defined between a pair of moving opposed casting surfaces to form a continuously cast metal article. A top or bottom surface of the molten metal injector nozzle has a distal most end that can be positioned at a vertical distance of about 1.4 mm or less (e.g., about 1.0 mm or less) from at least one moving casting surface in the pair of moving opposed casting surfaces to minimize the number of exudates present in the surface of the continuously cast metal article. Optionally, the pair of moving opposed casting surfaces is a pair of moving opposed belts, opposed rolls, or opposed blocks. The method can further include withdrawing a continuously cast metal sheet from an exit of the casting cavity. The continuously cast metal sheet can be an aluminum alloy sheet (e.g., a 6xxx series aluminum alloy sheet, a 5xxx series aluminum alloy sheet, or a 7xxx series aluminum alloy sheet). Metal products prepared according to the methods for continuously casting a metal article are also described herein.

Other objects, aspects, and advantages will become apparent upon consideration of the following detailed description of non-limiting examples.

BRIEF DESCRIPTION OF THE FIGURES

FIG. 7, Panel A is a low magnification digital image. FIG. 7, Panels B and C are higher magnification digital images of areas shown in FIG. 7, Panel A.

FIG. 8, Panel A is a low magnification digital image. FIG. 8, Panels B and C are higher magnification digital images of areas shown in FIG. 8, Panel A.

DETAILED DESCRIPTION

Figure 1A:
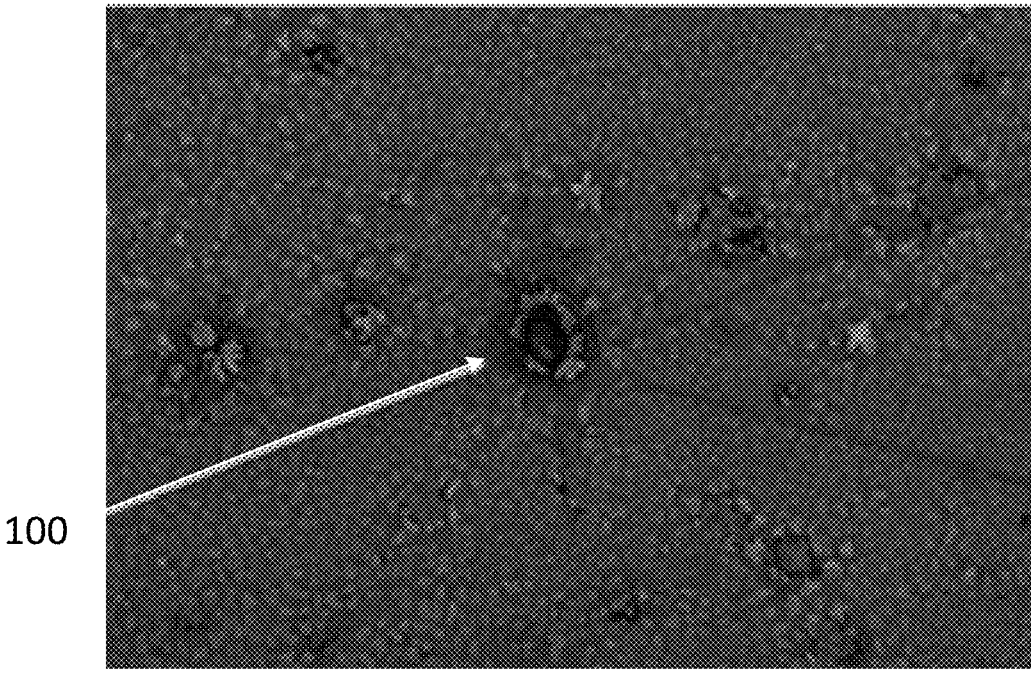
FIG. 1A is a scanning electron microscope (SEM) micrograph of an aluminum alloy product containing an exudate within the surface.

Provided herein are continuously cast aluminum alloy products having desirable surface properties and systems and methods to reduce and/or eliminate surface defects in the products. During a continuous casting process, as molten metal contacts a pair of moving opposed casting surfaces, the molten metal can locally cool and contract, pulling away from the pair of moving opposed casting surfaces. As the molten metal pulls away from the pair of moving opposed casting surfaces, local remelting can occur around grains in the aluminum matrix. The remelting can cause molten metal and alloying elements to leak from around the grain and/or cause the grain to at least partially exude from the aluminum matrix surface, creating areas of protruding alloying elements (i.e., intermetallic particles). A plurality of these intermetallic particles (e.g., a cluster of intermetallic particles) is referred to herein as an exudate.

In addition, the continuous casting of metals can result in meniscus oscillation marks visible on the surface of the metal. Specifically, injecting molten metal into the space between a pair of moving opposed casting surfaces can provide a meniscus in a space between a distal most end of a molten metal injector nozzle and the pair of moving opposed casting surfaces. In some cases, the meniscus can undergo an oscillation that can cause varying thermal gradients in the surface of a solidifying molten metal as the meniscus oscillates, resulting in meniscus oscillation marks on the surface of the metal. In some examples, exudates preferentially form along the meniscus oscillation marks. The exudates can remain in the surface of the cast aluminum alloy or other metal product during subsequent processing, thus creating surface defects when the aluminum alloy product is processed to a final gauge. In some cases, large exudates (e.g., greater than about 100 μm in diameter) can be a significant problem in terms of surface quality of the aluminum alloy or other metal product after processing to a final gauge. The exudates can have a different chemical composition than an aluminum matrix, and can have a different electrochemical potential. In some aspects, the exudates can be anodic with respect to the metal (e.g., aluminum) matrix. Subsequent surface treatment (e.g., acid etch) can preferentially dissolve the exudates, which results in a defect in the surface of the metal. In some other aspects, subsequent surface treatment can preferentially dissolve the metal matrix, leaving a defect on the surface of the metal. The systems and methods described herein reduce surface defects in the products, resulting in continuously cast aluminum alloy products having superior surface properties as compared to products prepared according to conventional continuous casting methods.

Definitions and Descriptions

As used herein, the terms "invention," "the invention," "this invention" and "the present invention" are intended to refer broadly to all of the subject matter of this patent application and the claims below. Statements containing these terms should be understood not to limit the subject matter described herein or to limit the meaning or scope of the patent claims below.

In this description, reference is made to alloys identified by aluminum industry designations, such as "series" or "6xxx." For an understanding of the number designation system most commonly used in naming and identifying aluminum and its alloys, see "International Alloy Designations and Chemical Composition Limits for Wrought Aluminum and Wrought Aluminum Alloys" or "Registration Record of Aluminum Association Alloy Designations and Chemical Compositions Limits for Aluminum Alloys in the Form of Castings and Ingot," both published by The Aluminum Association.

As used herein, the meaning of "a," "an," or "the" includes singular and plural references unless the context clearly dictates otherwise.

All ranges disclosed herein are to be understood to encompass any and all subranges subsumed therein. For example, a stated range of "1 to 10" should be considered to include any and all subranges between (and inclusive of) the minimum value of 1 and the maximum value of 10; that is, all subranges beginning with a minimum value of 1 or more, e.g. 1 to 6.1, and ending with a maximum value of 10 or less, e.g., 5.5 to 10.

As used herein, a "plate" generally has a thickness of greater than about 15 mm. For example, a plate may refer to an aluminum product having a thickness of greater than 15 mm, greater than 20 mm, greater than 25 mm, greater than 30 mm, greater than 35 mm, greater than 40 mm, greater than 45 mm, greater than 50 mm, or greater than 100 mm.

As used herein, a "shate" (also referred to as a sheet plate) generally has a thickness of from about 4 mm to about 15 mm. For example, a shate may have a thickness of 4 mm, 5 mm, 6 mm, 7 mm, 8 mm, 9 mm, 10 mm, 11 mm, 12 mm, 13 mm, 14 mm, or 15 mm.

As used herein, a "sheet" generally refers to an aluminum product having a thickness of less than about 4 mm. For example, a sheet may have a thickness of less than 4 mm, less than 3 mm, less than 2 mm, less than 1 mm, less than 0.5 mm, less than 0.3 mm, or less than 0.1 mm.

As used herein, terms such as "cast metal article," "cast article," and the like are interchangeable and refer to a product produced by direct chill casting (including direct chill co-casting) or semi-continuous casting, continuous casting (including, for example, by use of a twin belt caster, a twin roll caster, a block caster, or any other continuous caster), electromagnetic casting, hot top casting, or any other casting method.

Aluminum Alloy Products

Described herein are metal products, including aluminum alloy products, having desired surface properties. Among other properties, the aluminum alloy products described herein display a uniform surface due to the distribution of intermetallic particles. The intermetallic particles in the aluminum alloy products described herein are more diffuse and less clustered, which results in a superior final aluminum alloy product that exhibits minimal streaks on the surface.

The aluminum alloy product can have any suitable composition. In non-limiting examples, the aluminum alloy products can include a 1xxx series aluminum alloy, a 2xxx series aluminum alloy, a 3xxx series aluminum alloy, a 4xxx series aluminum alloy, a 5xxx series aluminum alloy, a 6xxx series aluminum alloy, a 7xxx series aluminum alloy, or an 8xxx series aluminum alloy.

By way of non-limiting example, exemplary AA1xxx series alloys for use as the aluminum alloy product can include AA1100, AA1100A, AA1200, AA1200A, AA1300, AA1110, AA1120, AA1230, AA1230A, AA1235, AA1435, AA1145, AA1345, AA1445, AA1150, AA1350, AA1350A, AA1450, AA1370, AA1275, AA1185, AA1285, AA1385, AA1188, AA1190, AA1290, AA1193, AA1198, and AA1199.

By way of non-limiting example, exemplary AA2xxx series alloys for use as the aluminum alloy product can include AA2001, A2002, AA2004, AA2005, AA2006, AA2007, AA2007A, AA2007B, AA2008, AA2009, AA2010, AA2011, AA2011A, AA2111, AA2111A, AA2111B, AA2012, AA2013, AA2014, AA2014A, AA2214, AA2015, AA2016, AA2017, AA2017A, AA2117, AA2018, AA2218, AA2618, AA2618A, AA2219, AA2319, AA2419, AA2519, AA2021, AA2022, AA2023, AA2024, AA2024A, AA2124, AA2224, AA2224A, AA2324, AA2424, AA2524, AA2624, AA2724, AA2824, AA2025, AA2026, AA2027, AA2028, AA2028A, AA2028B, AA2028C, AA2029, AA2030, AA2031, AA2032, AA2034, AA2036, AA2037, AA2038, AA2039, AA2139, AA2040, AA2041, AA2044, AA2045, AA2050, AA2055, AA2056, AA2060, AA2065, AA2070, AA2076, AA2090, AA2091, AA2094, AA2095, AA2195, AA2295, AA2196, AA2296, AA2097, AA2197, AA2297, AA2397, AA2098, AA2198, AA2099, and AA2199.

By way of non-limiting example, exemplary AA3xxx series alloys for use as the aluminum alloy product can include AA3002, AA3102, AA3003, AA3103, AA3103A, AA3103B, AA3203, AA3403, AA3004, AA3004A, AA3104, AA3204, AA3304, AA3005, AA3005A, AA3105, AA3105A, AA3105B, AA3007, AA3107, AA3207, AA3207A, AA3307, AA3009, AA3010, AA3110, AA3011, AA3012, AA3012A, AA3013, AA3014, AA3015, AA3016, AA3017, AA3019, AA3020, AA3021, AA3025, AA3026, AA3030, AA3130, and AA3065.

By way of non-limiting example, exemplary AA4xxx series alloys for use as the aluminum alloy product can include AA4004, AA4104, AA4006, AA4007, AA4008, AA4009, AA4010, AA4013, AA4014, AA4015, AA4015A, AA4115, AA4016, AA4017, AA4018, AA4019, AA4020, AA4021, AA4026, AA4032, AA4043, AA4043A, AA4143, AA4343, AA4643, AA4943, AA4044, AA4045, AA4145, AA4145A, AA4046, AA4047, AA4047A, and AA4147.

Non-limiting exemplary AA5xxx series alloys for use as the aluminum alloy product can include AA5xxx alloys for use as the aluminum alloy product can include AA5182, AA5183, AA5005, AA5005A, AA5205, AA5305, AA5505, AA5605, AA5006, AA5106, AA5010, AA5110, AA5110A, AA5210, AA5310, AA5016, AA5017, AA5018, AA5018A, AA5019, AA5019A, AA5119, AA5119A, AA5021, AA5022, AA5023, AA5024, AA5026, AA5027, AA5028, AA5040, AA5140, AA5041, AA5042, AA5043, AA5049, AA5149, AA5249, AA5349, AA5449, AA5449A, AA5050, AA5050A, AA5050C, AA5150, AA5051, AA5051A, AA5151, AA5251, AA5251A, AA5351, AA5451, AA5052, AA5252, AA5352, AA5154, AA5154A, AA5154B, AA5154C, AA5254, AA5354, AA5454, AA5554, AA5654, AA5654A, AA5754, AA5854, AA5954, AA5056, AA5356, AA5356A, AA5456, AA5456A, AA5456B, AA5556, AA5556A, AA5556B, AA5556C, AA5257, AA5457, AA5557, AA5657, AA5058, AA5059, AA5070, AA5180, AA5180A, AA5082, AA5182, AA5083, AA5183, AA5183A, AA5283, AA5283A, AA5283B, AA5383, AA5483, AA5086, AA5186, AA5087, AA5187, and AA5088.

Non-limiting exemplary AA6xxx series alloys for use as the aluminum alloy product can include AA6101, AA6101A, AA6101B, AA6201, AA6201A, AA6401, AA6501, AA6002, AA6003, AA6103, AA6005, AA6005A, AA6005B, AA6005C, AA6105, AA6205, AA6305, AA6006, AA6106, AA6206, AA6306, AA6008, AA6009, AA6010, AA6110, AA6110A, AA6011, AA6111, AA6012, AA6012A, AA6013, AA6113, AA6014, AA6015, AA6016, AA6016A, AA6116, AA6018, AA6019, AA6020, AA6021, AA6022, AA6023, AA6024, AA6025, AA6026, AA6027, AA6028, AA6031, AA6032, AA6033, AA6040, AA6041, AA6042, AA6043, AA6151, AA6351, AA6351A, AA6451, AA6951, AA6053, AA6055, AA6056, AA6156, AA6060, AA6160, AA6260, AA6360, AA6460, AA6460B, AA6560, AA6660, AA6061, AA6061A, AA6261, AA6361, AA6162, AA6262, AA6262A, AA6063, AA6063A, AA6463, AA6463A, AA6763, A6963, AA6064, AA6064A, AA6065, AA6066, AA6068, AA6069, AA6070, AA6081, AA6181, AA6181A, AA6082, AA6082A, AA6182, AA6091, and AA6092.

Non-limiting exemplary AA7xxx series alloys for use as the aluminum alloy product can include AA7011, AA7019, AA7020, AA7021, AA7039, AA7072, AA7075, AA7085, AA7108, AA7108A, AA7015, AA7017, AA7018, AA7019A, AA7024, AA7025, AA7028, AA7030, AA7031, AA7033, AA7035, AA7035A, AA7046, AA7046A, AA7003, AA7004, AA7005, AA7009, AA7010, AA7011, AA7012, AA7014, AA7016, AA7116, AA7122, AA7023, AA7026, AA7029, AA7129, AA7229, AA7032, AA7033, AA7034, AA7036, AA7136, AA7037, AA7040, AA7140, AA7041, AA7049, AA7049A, AA7149, 7204, AA7249, AA7349, AA7449, AA7050, AA7050A, AA7150, AA7250, AA7055, AA7155, AA7255, AA7056, AA7060, AA7064, AA7065, AA7068, AA7168, AA7175, AA7475, AA7076, AA7178, AA7278, AA7278A, AA7081, AA7181, AA7185, AA7090, AA7093, AA7095, and AA7099.

By way of non-limiting example, exemplary AA8xxx series alloys for use as the aluminum alloy product can include AA8005, AA8006, AA8007, AA8008, AA8010, AA8011, AA8011A, AA8111, AA8211, AA8112, AA8014, AA8015, AA8016, AA8017, AA8018, AA8019, AA8021, AA8021A, AA8021B, AA8022, AA8023, AA8024, AA8025, AA8026, AA8030, AA8130, AA8040, AA8050, AA8150, AA8076, AA8076A, AA8176, AA8077, AA8177, AA8079, AA8090, AA8091, and AA8093.

The aluminum alloy products include a first surface having a width that has minimal surface defects in the form of exudates. As described above, an exudate is a plurality of intermetallic particles (e.g., clusters of intermetallic particles) that leak from around grains in the aluminum matrix. The aluminum alloy products include an average of about 50 exudates or less per square centimeter ($cm^2$) across the width of the first surface. For example, the surfaces of the disclosed aluminum alloy products include an average of about 45 exudates or less per $cm^2$, about 40 exudates or less per $cm^2$, about 35 exudates or less per $cm^2$, about 30 exudates or less per $cm^2$, about 25 exudates or less per $cm^2$, about 20 exudates or less per $cm^2$, about 15 exudates or less per $cm^2$, about 10 exudates or less per $cm^2$, or about 5 exudates or less per $cm^2$. In some examples, exudates are not present across the first surface.

In some cases, the width of the first surface is homogenously populated with intermetallic particles or exudates. As used herein, "homogeneously populated" as related to intermetallic particle and/or exudate distribution means that the intermetallic particles are evenly distributed within the width of the surface. In these cases, the number of particles per region of the width of the surface is relatively constant across regions, on average. As used herein, "relatively constant" as related to intermetallic particle and/or exudate distribution means that the number of particles in a first region of the width can differ from the number of particles in a second region of the width by up to about 20% (e.g., by up to about 15%, by up to about 10%, by up to about 5%, or by about up to 1%).

In other cases, the width of the first surface is variably populated with intermetallic particles or exudates. As used herein, "variably populated" as related to intermetallic particle and/or exudate distribution means that the intermetallic particles or exudates are not evenly distributed within the width of the surface. For example, a larger number of intermetallic particles may be present in a first region of the surface as compared to the number of intermetallic particles present in a second region of the surface. Whether homogenously populated or variably populated, in some examples, the first surface includes 50 exudates or less per $cm^2$ when taking the average across the width of the first surface.

In some cases, each exudate has a size of from about 50 μm to about 300 μm in diameter on average across the width of the first surface. For example, the exudates can have an average diameter of about 50 μm, about 60 μm, about 70 μm, about 80 μm, about 90 μm, about 100 μm, about 110 μm, about 120 μm, about 130 μm, about 140 μm, about 150 μm, about 160 μm, about 170 μm, about 180 μm, about 190 μm, about 200 μm, about 210 μm, about 220 μm, about 230 μm, about 240 μm, about 250 μm, about 260 μm, about 270 μm, about 280 μm, about 290 μm, about 300 μm, or anywhere in between.

In some non-limiting examples, the exudates can include a plurality of iron-containing intermetallic particles. In some further examples, the exudates can be silicon-containing intermetallic particles. The intermetallic particles can differ in composition from the aluminum matrix and can therefore have a different electrochemical potential than the aluminum matrix. Based on the composition of the aluminum alloy, the intermetallic particles can be anodic to the aluminum matrix or the aluminum matrix can be anodic to the intermetallic particles.

The exudates can extend from the first surface into an interior of the aluminum alloy product to a certain depth. Optionally, the depth is from about 10 μm to about 100 μm (e.g., from about 10 μm to about 30 μm). For example, the depth can be about 10 μm, 15 μm, 20 μm, 25 μm, 30 μm, 35 μm, 40 μm, 45 μm, 50 μm, 55 μm, 60 μm, 65 μm, 70 μm, 75 μm, 80 μm, 85 μm, 90 μm, 95 μm, 100 μm, or anywhere in between.

The aluminum alloy product can have any suitable gauge. For example, the aluminum alloy product can be an aluminum alloy plate, an aluminum alloy shate, or an aluminum alloy sheet having a gauge between about 0.5 mm and about 200 mm (e.g., about 0.5 mm, about 1 mm, about 2 mm, about 3 mm, about 4 mm, about 5 mm, about 6 mm, about 7 mm, about 8 mm, about 9 mm, about 10 mm, about 15 mm, about 20 mm, about 25 mm, about 30 mm, about 35 mm, about 40 mm, about 45 mm, about 50 mm, about 55 mm, about 60 mm, about 65 mm, about 70 mm, about 75 mm, about 80 mm, about 85 mm, about 90 mm, about 95 mm, about 100 mm, about 110 mm, about 120 mm, about 130 mm, about 140 mm, about 150 mm, about 160 mm, about 170 mm, about 180 mm, about 190 mm, about 200 mm, or anywhere in between).

Methods and Systems for Casting and Processing

The aluminum alloy products described herein can be cast using a continuous casting (CC) process. The CC process may include, but is not limited to, the use of twin belt casters, twin roll casters, or block casters.

Optionally, the casting described above can be performed using a continuous casting system as described herein. The continuous casting system can include a pair of moving opposed casting surfaces (e.g., moving opposed belts), a casting cavity between the pair of moving opposed casting surfaces, and a molten metal injector. The molten metal injector can have an end opening from which molten metal can exit the molten metal injector and be injected into the casting cavity. The end opening is referred to herein as the molten metal injector nozzle. The distal most end of the molten metal injector nozzle is the point at which the molten metal loses contact with the molten metal injector nozzle.

In some cases, positioning the distal most end of the molten metal injector nozzle at a decreased distance from the pair of moving opposed casting surfaces as described below can decrease the spacing of meniscus oscillation marks. The spacing between meniscus oscillation marks results, in part, from the height of the injector from at least one of the moving casting surfaces, the casting speed, and the frequency of meniscus oscillation (sometimes between around 100 to around 150 Hz). Decreasing the distance between the distal most end of the molten metal injector nozzle and at least one of the moving casting surfaces to a distance as described herein results in decreased meniscus mark spacing, which in turn results in reduced exudate formation.

Figure 9:
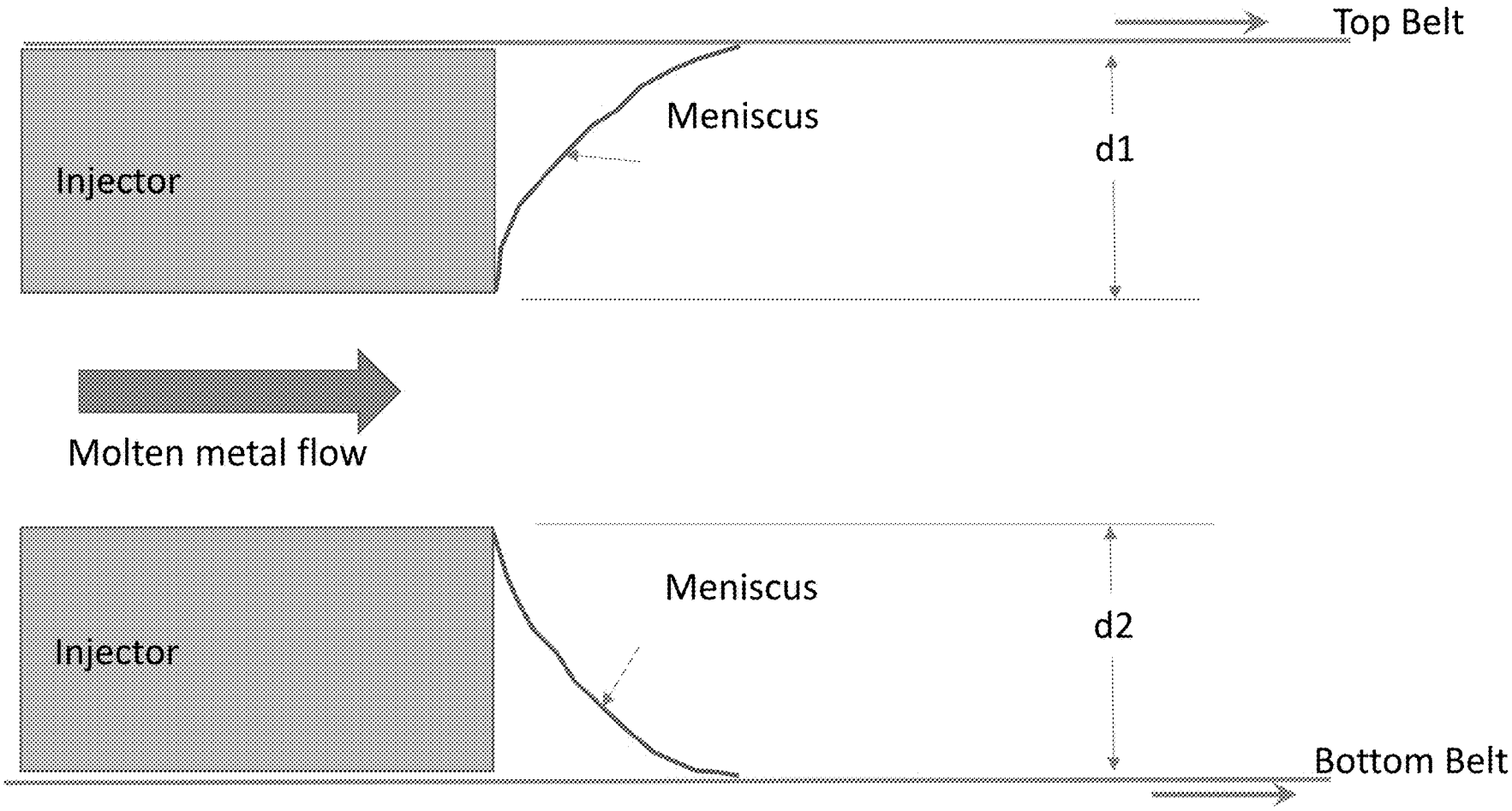
FIG. 9 is a schematic diagram depicting the distances of the molten metal injector nozzle from moving casting surfaces.

FIG. 9 contains a schematic diagram illustrating the positioning of the molten metal injector and one of the moving casting surfaces. As shown in FIG. 9, the distal most end of the molten metal injector nozzle, which is where the molten metal loses contact with the injector, is positioned at a vertical distance from the belt that is labeled as the step height.

In some examples, the molten metal injector nozzle in the system is configured and positioned such that the distal most end of the molten metal injector nozzle is at a vertical distance (sometimes referred to as step height) of about 1.4 mm or less from at least one of the moving casting surfaces in the pair of moving opposed casting surfaces. FIG. 9 illustrates the vertical distance d1 between the upper moving casting surface (referred to as the top belt in FIG. 9) and the injector, as well as the vertical distance d2 between the lower moving casting surface (referred to as the bottom belt in FIG. 9) and the injector. In some cases, the vertical distance d2 is measured from the surface of the lower moving casting surface of the pair of moving opposed casting surfaces to the bottom exterior surface of the distal most end of the molten metal injector nozzle (i.e., where the molten metal loses contact with the injector nozzle). In some cases, the vertical distance d1 is measured from the surface of the upper moving casting surface of the pair of moving opposed casting surfaces to the top exterior surface of the distal most end of the molten metal injector nozzle (i.e., where the molten metal loses contact with the injector nozzle). In some cases, the top exterior surface of the distal most end of the molten metal injector nozzle where the molten metal loses contact with the injector nozzle is the point at which an upper meniscus of the molten metal begins to form. In some cases, the bottom exterior surface of the distal most end of the molten metal injector nozzle where the molten metal loses contact with the injector nozzle is the point at which a lower meniscus of the molten metal begins to form.

As mentioned above, one or both of vertical distance d1 and d2 may be about 1.4 mm or less. For example, one or both of distances d1 and d2 can be about 1.0 mm or less. In some cases, one or both of distances d1 and d2 can be from about 0.01 mm to about 1.4 mm (e.g., from about 0.05 mm to about 1.0 mm or from about 0.1 mm to about 0.8 mm). For example, one or both of distances d1 and d2 can be about 1.4 mm or less, about 1.3 mm or less, about 1.2 mm or less, about 1.1 mm or less, about 1.0 mm or less, about 0.9 mm or less, about 0.8 mm or less, about 0.7 mm or less, about 0.6 mm or less, about 0.5 mm or less, about 0.4 mm or less, about 0.3 mm or less, about 0.2 mm or less, or about 0.1 mm or less. In some cases, one or both of distances d1 and d2 can be 0 mm. In other words, the distal most end of the molten metal injector nozzle can touch at least one of the moving casting surfaces in the pair of moving opposed casting surfaces. Vertical distance d1 may be the same as the vertical distance d2, although it need not be.

The use of the casting system described herein, including positioning the distal most end of the molten metal injector nozzle at a distance of about 1.4 mm or less from at least one of the moving casting surfaces, can result in reduced levels of exudate formation and meniscus oscillation marks within the surface of the aluminum alloy product. In some non-limiting examples, eliminating the meniscus oscillation marks (or minimizing the spacing between meniscus oscillation marks) by decreasing the vertical distance between the molten metal injector nozzle and at least one of the casting surfaces can reduce an amount of exudates occurring on the surface of the cast aluminum alloy. In some cases, the average number of exudates per $cm^2$ can be reduced to about 50 or less. For example, the average number of exudates per $cm^2$ can be reduced to about 50 or less, about 45 or less, about 40 or less, about 35 or less, about 30 or less, about 25 or less, about 20 or less, about 15 or less, about 10 or less, about 5 or less, about 1 or less, or anywhere in between. In some aspects, exudates are absent from the surface of the cast aluminum alloy.

In some cases, eliminating the oscillation marks or reducing the spacing between the oscillation marks can be provided by positioning a nozzle of the molten metal injector at a distance from the pair of moving opposed casting surfaces that is a factor of a distance between the meniscus oscillation marks that would otherwise form if the nozzle were positioned at a greater distance. For example, positioning the nozzle of the molten metal injector at a distance of about 1.4 mm from at least one of the pair of moving opposed casting surfaces can provide meniscus oscillation marks having a spacing between each meniscus oscillation mark of about 1.4 mm on average. Positioning the nozzle of the molten metal injector at a distance of about 1.0 mm from at least one of the pair of moving opposed casting surfaces can provide meniscus oscillation marks having a spacing between each meniscus oscillation mark of about 1.0 mm on average. Positioning the nozzle of the molten metal injector at a distance of about 0.5 mm from at least one of the pair of moving opposed casting surfaces can provide meniscus oscillation marks having a spacing between each meniscus oscillation mark of about 0.5 mm on average, thus reducing or eliminating the appearance of meniscus oscillation marks.

In some examples, the method of continuously casting a metal article includes using the system described above. The method includes providing a molten metal as described herein and continuously injecting the molten metal from a molten metal injector into a casting cavity to form a continuously cast metal article. The method also can include withdrawing the continuously cast metal article, such as a continuously cast metal sheet, from an exit of the casting cavity.

The continuously cast article can then be processed by any means known to those of ordinary skill in the art. Optionally, the processing steps can be used to prepare sheets. Such processing steps can include, but are not limited to, homogenization and hot rolling. In some non-limiting examples, as explained in more detail below, a continuously cast aluminum alloy, such as a 6xxx series aluminum alloy, a 5xxx series aluminum alloy, or a 7xxx series aluminum alloy, can be hot rolled to a final gauge. The processing can be performed without a cold rolling step (i.e., the continuously cast article can be rolled to a final gauge without cold rolling). In some cases, hot rolling a continuously cast aluminum alloy to a final gauge can reduce or eliminate the detrimental effect of the exudates by spreading out the intermetallic particles associated with exudates. The spreading of the intermetallic particles can decrease any localized corrosion that may occur.

The method can optionally include a step of quenching the cast metal article after casting. The cast metal article can be cooled to a temperature at or below about 300° C. in the quenching step. For example, the cast metal article can be cooled to a temperature at or below about 290° C., at or below about 280° C., at or below about 270° C., at or below about 260° C., at or below about 250° C., at or below about 240° C., at or below about 230° C., at or below about 220° C., at or below about 210° C., at or below about 200° C., at or below about 190° C., at or below about 180° C., at or below about 170° C., at or below about 160° C., at or below about 150° C., at or below about 140° C., at or below about 130° C., at or below about 120° C., at or below about 110° C., or at or below about 100° C. The cast metal article can be quenched immediately after casting or within a short period of time thereafter (e.g., within about 10 hours or less, about 9 hours or less, about 8 hours or less, about 7 hours or less, about 6 hours or less, about 5 hours or less, about 4 hours or less, about 3 hours or less, about 2 hours or less, about 1 hour or less, or about 30 minutes or less). The cast metal article can optionally be coiled and stored after casting and/or quenching.

The cast metal article, in coiled or uncoiled form, can then be reheated to a certain temperature. In some cases, the cast metal article can be reheated to a temperature at or above about 400° C. For example, the cast metal article can be reheated to a temperature at or above about 410° C., at or above about 420° C., at or above about 430° C., at or above about 440° C., at or above about 450° C., at or above about 460° C., at or above about 470° C., at or above about 480° C., at or above about 490° C., at or above about 500° C., at or above about 510° C., at or above about 520° C., at or above about 530° C., or at or above about 540° C.

The method also includes a step of hot rolling the cast metal article. Optionally, the hot rolling step can be performed immediately after casting. Optionally, the hot rolling step can be performed immediately after reheating or after quenching. The hot rolling temperature can be at least about 350° C. For example, the hot rolling temperature can be at least about 360° C., at least about 370° C., at least about 380° C., at least about 390° C., at least about 400° C., at least about 410° C., at least about 420° C., at least about 430° C., at least about 440° C., at least about 450° C., at least about 460° C., at least about 470° C., at least about 480° C., at least about 490° C., or at least about 500° C. In some cases, the hot rolling temperature can be from about 400° C. to about 600° C. (e.g., from about 425° C. to about 575° C., from about 450° C. to about 550° C., from about 450° C. to about 600° C., or from about 475° C. to about 525° C.). Optionally, the hot rolling temperature can be the recrystallization temperature of the aluminum alloy.

During the hot rolling step, the gauge of the cast metal article is reduced in thickness. The number of exudates, or defects, per $cm^2$ decreases proportionally to the percent gauge reduction during the hot rolling step. In some cases, the total amount of reduction of thickness during hot rolling can be at least about 50%. For example, the hot rolling step can result in a thickness reduction of the cast metal article by at least about 55%, at least about 60%, at least about 65%, at least about 70%, at least about 75%, at least about 80%, or at least about 85%. In some examples, the gauge thickness reduction can be 50%. In some cases, the product can be a metal sheet wherein the final gauge of the product is about 10 mm or less, about 9 mm or less, about 8 mm or less, about 7 mm or less, about 6 mm or less, about 5 mm or less, about 4 mm or less, about 3 mm or less, about 2 mm or less, about 1 mm, or about 0.5 mm or less.

Methods of Use

The aluminum alloy products described herein can be used in automotive applications and other transportation applications, including aircraft and railway applications. For example, the aluminum alloy products can be used to prepare automotive structural parts, such as outer panels, inner panels, side panels, bumpers, side beams, roof beams, cross beams, pillar reinforcements (e.g., A-pillars, B-pillars, and C-pillars), inner hoods, outer hoods, or trunk lid panels. The aluminum alloy products and methods described herein can also be used in aircraft or railway vehicle applications, to prepare, for example, external and internal panels.

The aluminum alloy products and methods described herein can also be used in electronics applications. For example, the aluminum alloy products and methods described herein can be used to prepare housings for electronic devices, including mobile phones and tablet computers. In some examples, the aluminum alloy products can be used to prepare anodized quality sheets and materials.

The following examples will serve to further illustrate the present invention without, at the same time, however, constituting any limitation thereof. On the contrary, it is to be clearly understood that resort can be had to various embodiments, modifications and equivalents thereof which, after reading the description herein, can suggest themselves to those skilled in the art without departing from the spirit of the invention. During the studies described in the following examples, conventional procedures were followed, unless otherwise stated. Some of the procedures are described below for illustrative purposes.

EXAMPLES

Example 1: Exudates and Meniscus Oscillation Marks in as-Cast Material

Figure 1B:
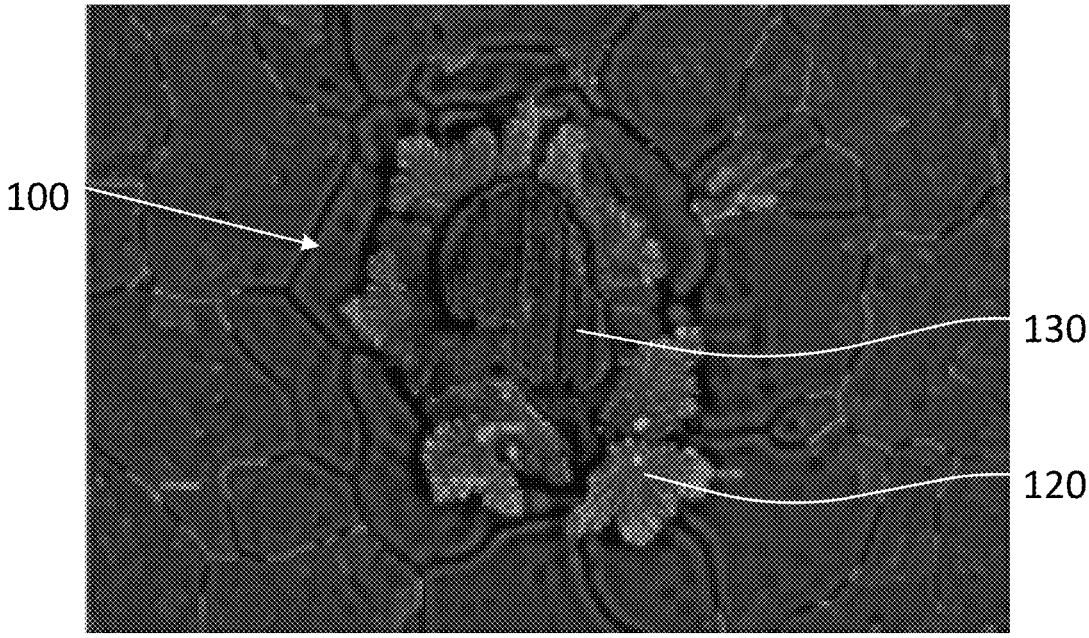
FIG. 1B is a SEM micrograph of an exudate within the surface of an aluminum alloy product.

A 6xxx series aluminum alloy was cast using a conventional continuous casting method to provide an aluminum alloy product including exudates within the surface of the product. FIG. 1A is a SEM micrograph showing an exudate 100 in the aluminum alloy prior to any further processing. FIG. 1B is a higher magnification SEM micrograph of the exudate 100. Expulsion of intermetallic particles 120 is evident around the grain 130.

Figure 2:
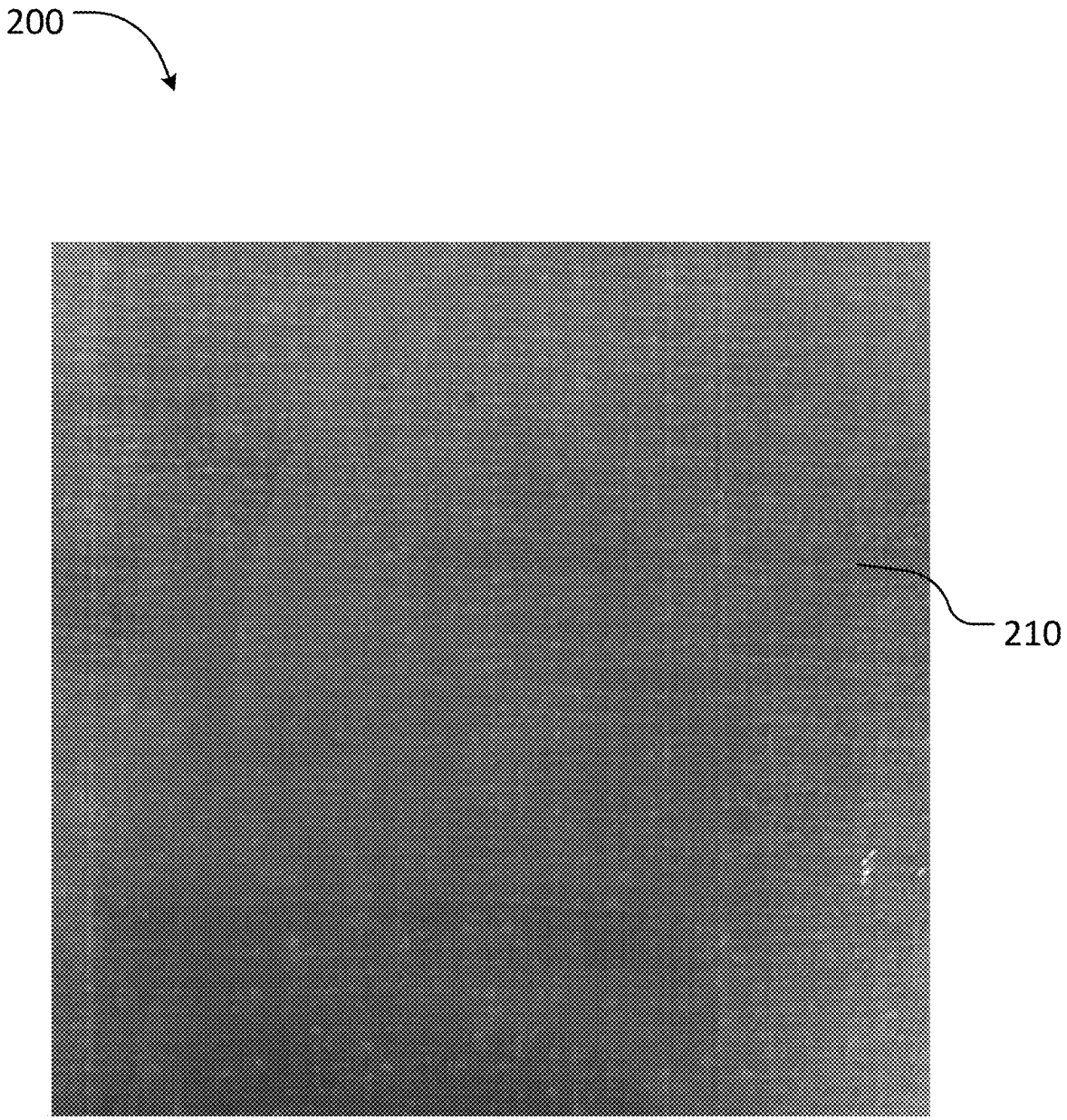
FIG. 2 is a digital image of meniscus oscillation marks within the surface of an aluminum alloy product.
Figure 3:
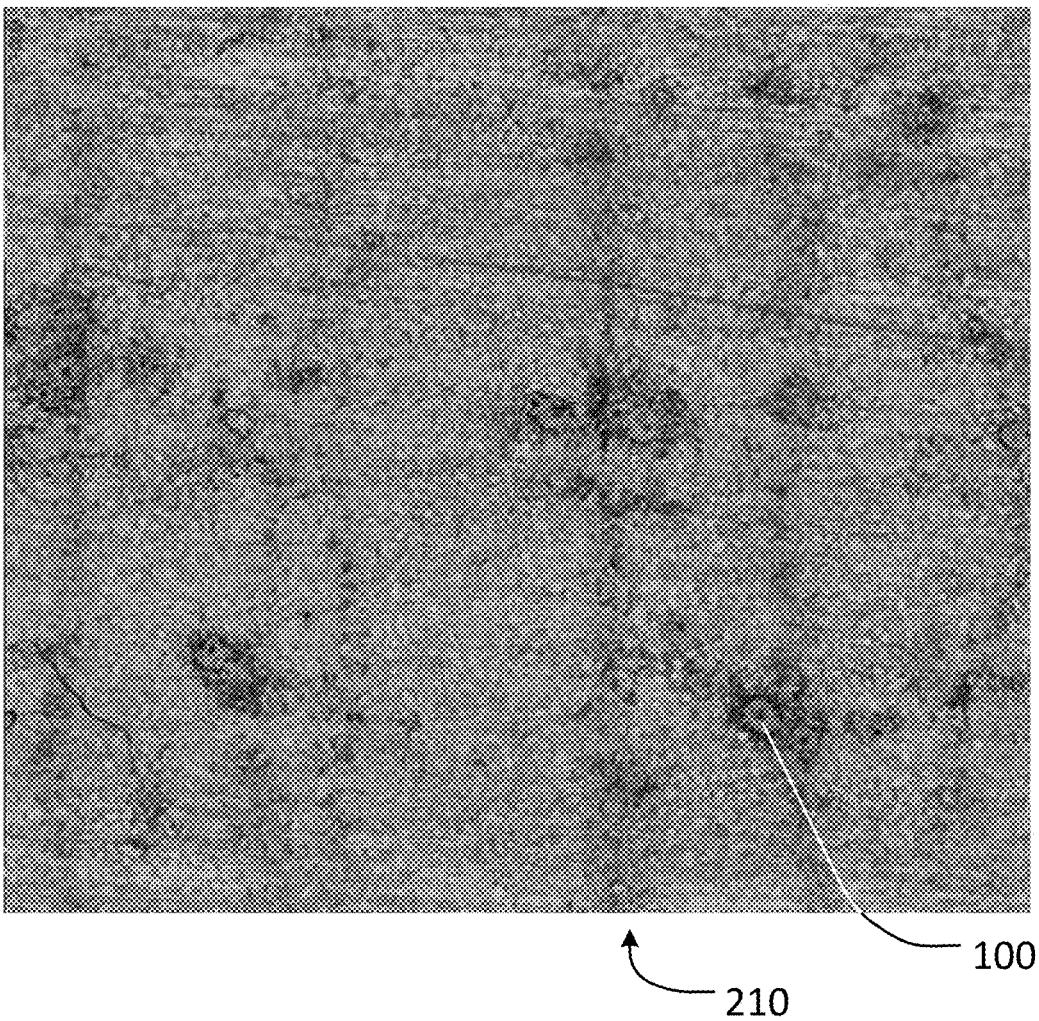
FIG. 3 is a micrograph showing exudate formation along meniscus oscillation marks within the surface of an aluminum alloy product.

FIG. 2 is a digital image of a 6xxx series aluminum alloy surface 200 showing meniscus oscillation marks 210 in the aluminum alloy surface 200. FIG. 3 is a micrograph showing meniscus oscillation marks 210 and exudates 100. As shown in FIG. 3, exudates 100 preferentially form along the meniscus oscillation marks 210.

Example 2: Rolling Processes

Figure 4:
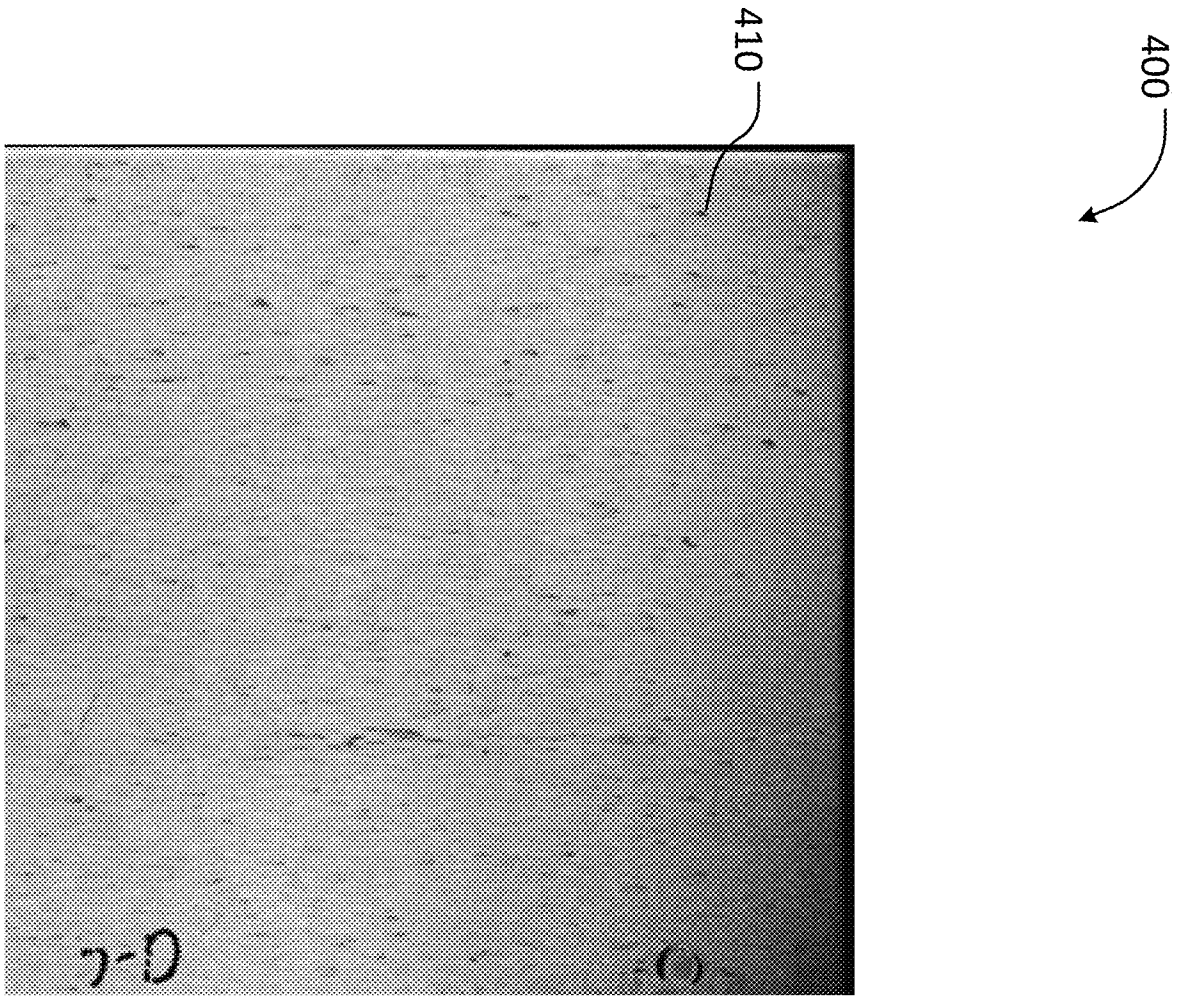
FIG. 4 is a digital image of surface defects in a comparative cold rolled aluminum alloy product.

The surface defects of aluminum alloys prepared using continuous casting followed by cold rolling were compared to those of aluminum alloys prepared using continuous casting followed by hot rolling to final gauge without a cold rolling step. The exudates 100 were present in significant quantities in the cold rolled material. FIG. 4 is a digital image of a comparative cold rolled 6xxx series aluminum alloy surface 400. The surface of the cold rolled aluminum alloy was direct anodized to enhance the appearance of the exudates. The comparative cold rolled aluminum alloy surface contains a plurality of black streaks 410. The black streaks 410 are a result of circular defects (e.g., exudates 100) being present during cold rolling and being rolled into the comparative cold rolled aluminum alloy surface 400.

Figure 5:
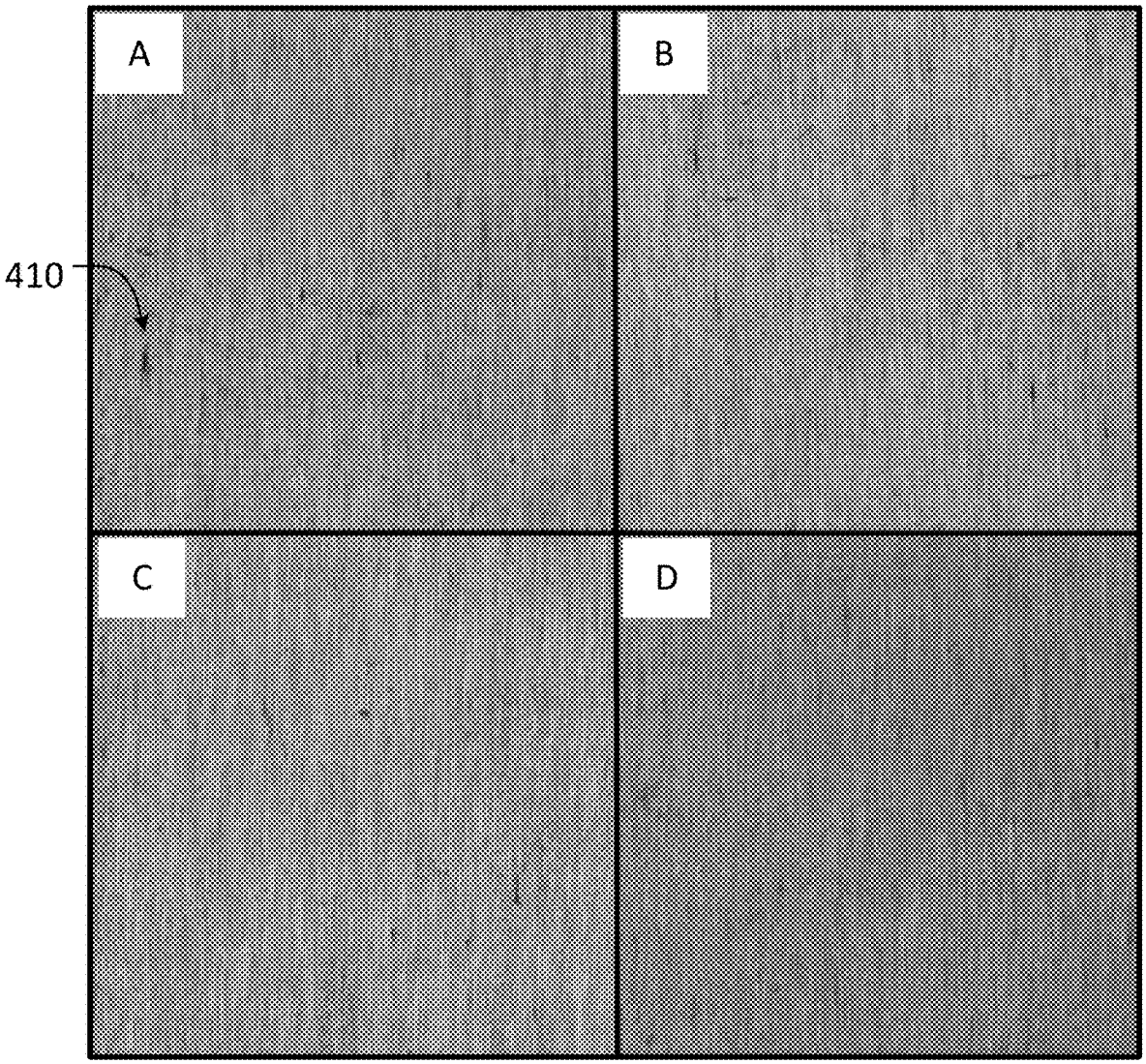
FIG. 5 contains digital images showing the surface of an exemplary hot rolled aluminum alloy product.

FIG. 5 presents a series of digital images illustrating exudate defect reduction, due to the spreading out of the intermetallics, in an aluminum alloy surface that was hot rolled to final gauge without a cold rolling step. The surface of the aluminum alloy was direct anodized to enhance the appearance of the exudates. FIG. 5, Panel A is a digital image of a hot rolled aluminum alloy surface of an aluminum alloy that was continuously cast, preheated to a temperature of about 450° C., allowed to cool to a temperature of about 350° C., and hot rolled at a temperature of about 350° C. A minimized number of black streaks 410, as compared to the cold rolled material, is visible throughout the hot rolled aluminum alloy surface. FIG. 5, Panel B is a digital image of a hot rolled aluminum alloy surface of an aluminum alloy that was continuously cast, preheated to a temperature of about 500° C., allowed to cool to a temperature of about 350° C., and hot rolled at a temperature of about 350° C. A minimized number of black streaks 410, as compared to the cold rolled material, is visible throughout the hot rolled aluminum alloy surface. In addition, preheating to a higher temperature and hot rolling provided a reduction in surface defects. FIG. 5, Panel C is a digital image of a hot rolled aluminum alloy surface of an aluminum alloy that was continuously cast, preheated to a temperature of about 540° C., allowed to cool to a temperature of about 350° C., and hot rolled at a temperature of about 350° C. A minimized number of black streaks 410, as compared to the cold rolled material, is visible throughout the hot rolled aluminum alloy surface. In addition, preheating at a still higher temperature and hot rolling provided a further reduction in surface defects. FIG. 5, Panel D is a digital image of a hot rolled aluminum alloy surface of an aluminum alloy that was continuously cast, preheated to a temperature of about 500° C., maintained at a temperature of about 500° C., and hot rolled at a temperature of about 500° C. Black streaks 410 are not visible in the hot rolled aluminum alloy surface. Hot rolling at an elevated temperature provided an aluminum alloy surface with minimal to no surface defects.

Figure 6:
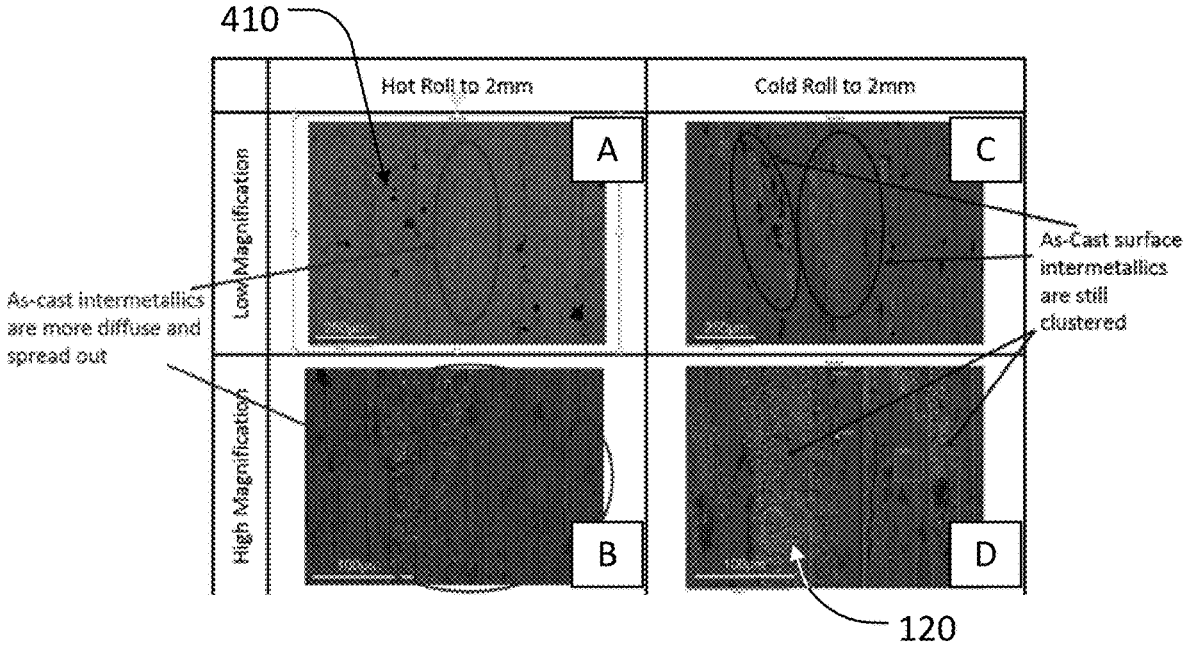
FIG. 6 contains digital images comparing surface defects in an aluminum alloy prepared by a comparative cold rolling method and an aluminum alloy prepared by an exemplary hot rolling method.

FIG. 6 is a series of micrographs further illustrating that hot rolling a continuously cast aluminum alloy to a final gauge can reduce or eliminate defects associated with exudates 100 present on a surface of the continuously cast aluminum alloy by spreading out the intermetallics during hot rolling. An aluminum alloy was hot rolled at a temperature of 500° C. to a gauge of 2 mm, providing a total gauge reduction of 80%. FIG. 6, Panel A and FIG. 6, Panel B show that hot rolling at an elevated temperature can decrease the number and intensity of the black streaks 410. Intermetallic particles 120 can be more diffuse (i.e., well dispersed), providing fewer exudates in a surface of a continuously cast aluminum alloy hot rolled at an elevated temperature. A comparative cold rolled aluminum alloy is shown in FIG. 6, Panel C and FIG. 6, Panel D. The comparative cold rolled aluminum alloy was cold rolled to a gauge of 2 mm, representing a total gauge reduction of 80%. The black streaks 410 are present in a greater amount and are larger. Intermetallic particles 120 are shown to aggregate on a surface of the cold rolled aluminum alloy.

Example 3: Particle Distribution

Figure 7:
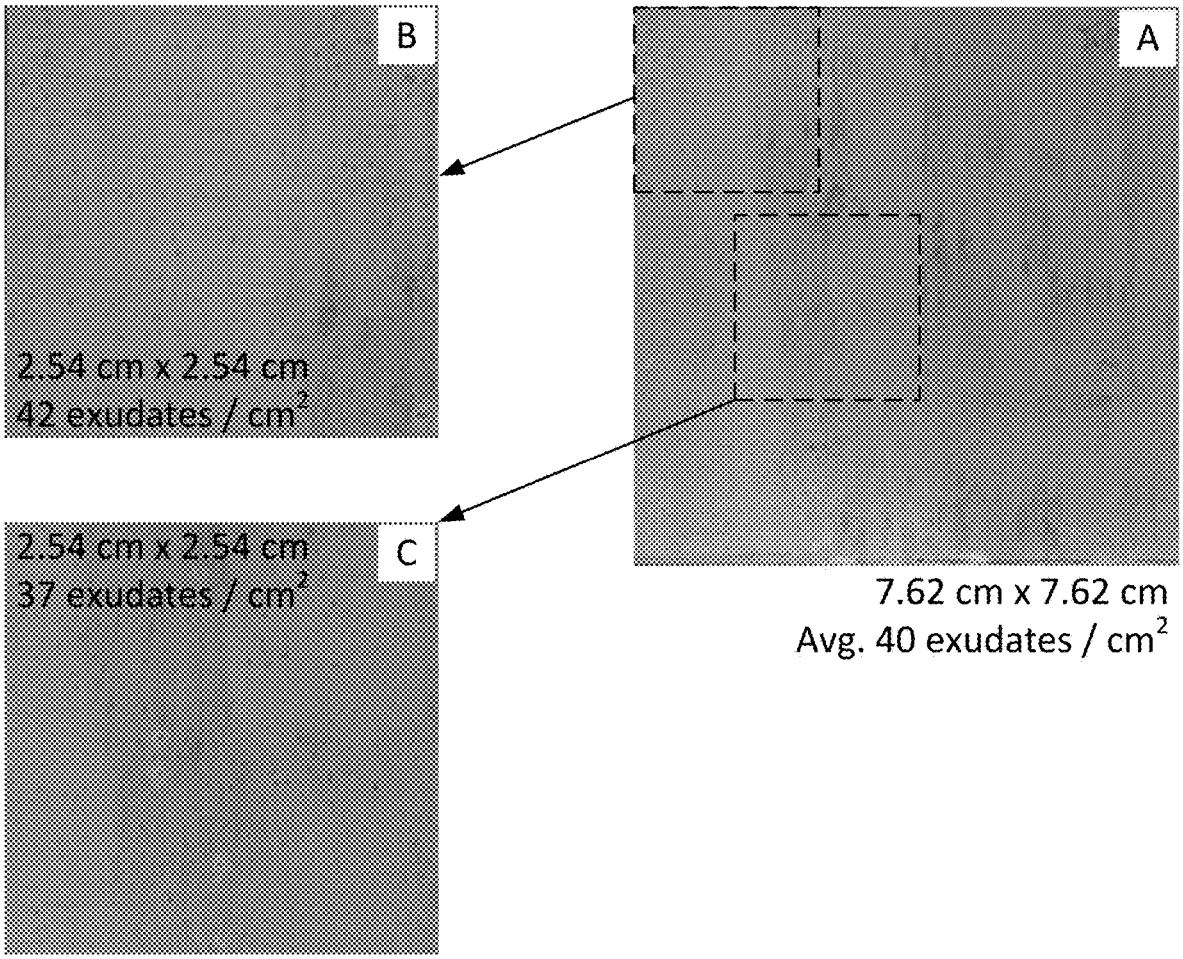
FIG. 7 (Panels A-C) contains digital images showing surface defects in an exemplary hot rolled aluminum alloy.
Figure 8:
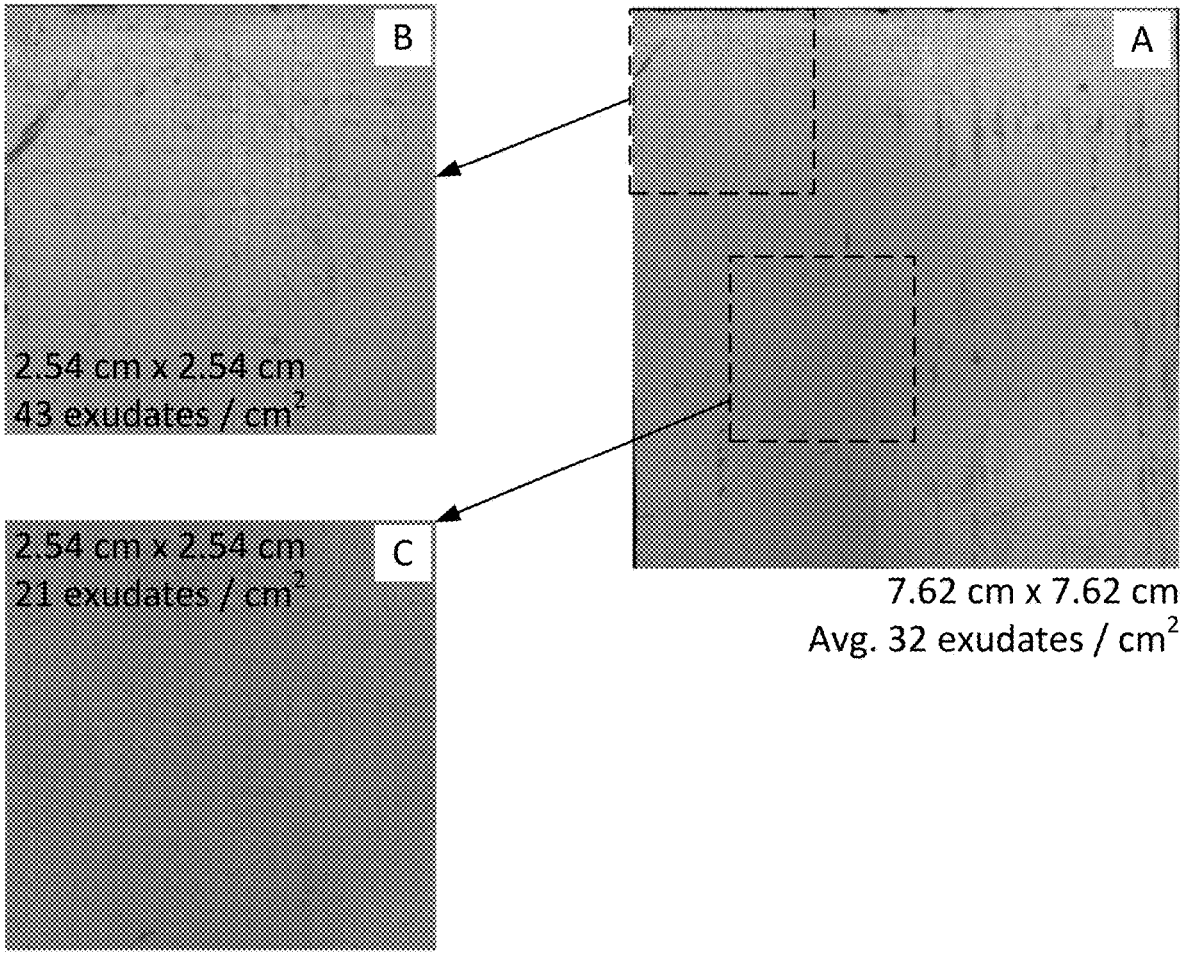
FIG. 8 (Panels A-C) contains digital images showing surface defects in an exemplary hot rolled metal.

FIGS. 7 and 8 contain digital images showing the surfaces of exemplary 6xxx aluminum sheets as-cast as described herein. FIG. 7 shows the top surface and FIG. 8 shows the bottom surface of the aluminum alloy sheet. FIG. 7, Panel A and FIG. 8, Panel A are low magnification digital images showing 7.62 cm×7.62 cm (3 in×3 in) sections of the surface. FIG. 7, Panels B and C and FIG. 8, Panels B and C are higher magnification digital images showing 2.54 cm×2.54 cm (1 in×1 in) sections of the respective Panel A sections. As shown in the figures, the hot rolled aluminum sheets as described herein include, on average, less than 50 exudates per square $cm^2$ in the snapshot taken from the width of the first surface.

All patents, publications and abstracts cited above are incorporated herein by reference in their entireties. Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the present invention as defined in the following claims.

What is claimed is:

1. A method of producing a metal strip, comprising:

providing a molten metal;

continuously casting by injecting the molten metal from a molten metal injector nozzle into a casting cavity defined between an upper moving casting surface and a lower moving casting surface that opposes the upper moving casting surface to form a cast metal article from the molten metal, wherein the molten metal injector nozzle is configured and positioned relative to the upper moving casting surface and the lower moving casting surface such that a first vertical distance d1 is 1.4 mm or less and a second vertical distance d2 is 1.4 mm or less, wherein the first vertical distance d1 is measured from the lower moving casting surface to a bottom exterior surface of the distal most end of the molten metal injector nozzle where the molten metal loses contact with the molten metal injector nozzle, and wherein the second vertical distance d2 is measured from the upper moving casting surface to a top exterior surface of the distal most end of the molten metal injector nozzle where the molten metal loses contact with the molten metal injector nozzle, and wherein the continuous casting has a meniscus oscillation frequency of between 100 to 150 Hz; and hot rolling the cast metal article after casting at a hot rolling temperature of at least about 350° C. to a gauge of 10 mm or less to produce a metal strip, wherein the hot rolling step results in a thickness reduction of the cast metal article by at least 50%.

2. The method of claim 1, wherein the hot rolling temperature is from about 450° C. to about 600° C.

3. The method of claim 1, wherein the cast metal article is an aluminum alloy sheet.

4. The method of claim 3, wherein the aluminum alloy sheet comprises a 6xxx series aluminum alloy sheet, a 5xxx series aluminum alloy sheet, or a 7xxx series aluminum alloy sheet.

5. The method of claim 3, wherein the aluminum alloy sheet has a first surface comprising exudates, and wherein the exudates have an average diameter of from about 50 μm to about 300 μm.

6. The method of claim 3, wherein the aluminum alloy sheet has a first surface comprising exudates, and wherein the exudates comprise iron-containing intermetallic particles.

7. The method of claim 1, further comprising a step of quenching the cast metal article after the continuous casting step and before the hot rolling step.

8. The method of claim 7, further comprising a step of reheating the cast metal article after quenching the cast metal article and before the hot rolling step.

9. The method of claim 1, wherein the bottom exterior surface of the distal most end of the molten metal injector nozzle is where a lower meniscus of the molten metal begins to form, and wherein the top exterior surface of the distal most end of the molten metal injector nozzle is where an upper meniscus of the molten metal begins to form.

10. The method of claim 1, wherein the distal most end of the molten metal injector nozzle touches the upper moving casting surface, the lower moving casting surface, or both.

* * * * *